US007522048B2

(12) United States Patent
Belden, Jr.

(10) Patent No.: US 7,522,048 B2
(45) Date of Patent: Apr. 21, 2009

(54) BANDING CLIP ALARM

(75) Inventor: Dennis D. Belden, Jr., Canton, OH (US)

(73) Assignee: Checkpoint Systems, Inc., Thorofare, NJ (US)

( * ) Notice: Subject to any disclaimer, the term of this patent is extended or adjusted under 35 U.S.C. 154(b) by 134 days.

(21) Appl. No.: 11/652,794

(22) Filed: Jan. 12, 2007

(65) Prior Publication Data

US 2008/0169924 A1 Jul. 17, 2008

(51) Int. Cl.
*G08B 13/12* (2006.01)

(52) U.S. Cl. ..... 340/568.4; 340/568.1; 70/57; 70/49; 242/382

(58) Field of Classification Search ..... 340/571, 340/568.1, 548, 568.2, 568.3; 70/57.1, 57, 70/58, 49; 242/382, 396.4
See application file for complete search history.

(56) References Cited

U.S. PATENT DOCUMENTS

| | | | | |
|---|---|---|---|---|
| 3,611,760 | A | 10/1971 | Muther | |
| 3,831,407 | A | 8/1974 | Coleman | |
| 3,953,991 | A * | 5/1976 | Grossman | 70/104 |
| 4,663,611 | A * | 5/1987 | Humphrey | 340/542 |
| 4,756,171 | A | 7/1988 | Homar | |
| 4,896,517 | A | 1/1990 | Ling | |
| 5,156,028 | A | 10/1992 | Jiang | |
| 5,610,587 | A * | 3/1997 | Fujiuchi et al. | 340/568.2 |
| 5,786,759 | A * | 7/1998 | Ling | 340/542 |
| 5,794,404 | A | 8/1998 | Kim | |
| 5,794,464 | A * | 8/1998 | Yeager et al. | 70/57 |
| 6,140,923 | A * | 10/2000 | Lam | 340/568.7 |
| 6,550,293 | B1 * | 4/2003 | Delegato et al. | 70/59 |
| 2006/0170549 | A1 * | 8/2006 | Belden et al. | 340/568.2 |
| 2006/0174667 | A1 * | 8/2006 | Garner | 70/57.1 |

FOREIGN PATENT DOCUMENTS

| | | | |
|---|---|---|---|
| GB | 2128790 A | * | 5/1984 |
| GB | 2242555 A | * | 10/1991 |

* cited by examiner

*Primary Examiner*—Eric M Blount
(74) *Attorney, Agent, or Firm*—Sand & Sebolt

(57) ABSTRACT

A security alarm is removably attached to a band extending about a package which sounds an alarm should tension on the band be reduced to prevent theft of the package contents. The band extends through a passage formed between the bottom of an alarm housing and a bottom lock plate pivotally connected to the housing. A plunger switch is mounted in the housing and engages the band. Reduction of the band tension permits the switch plunger to move and actuate an audible alarm. A slide lock locks the bottom lock plate to the alarm housing to prevent removal of the alarm from the band. A key unlocks the slide lock from the alarm housing enabling the alarm to be slid from beneath the band.

22 Claims, 10 Drawing Sheets

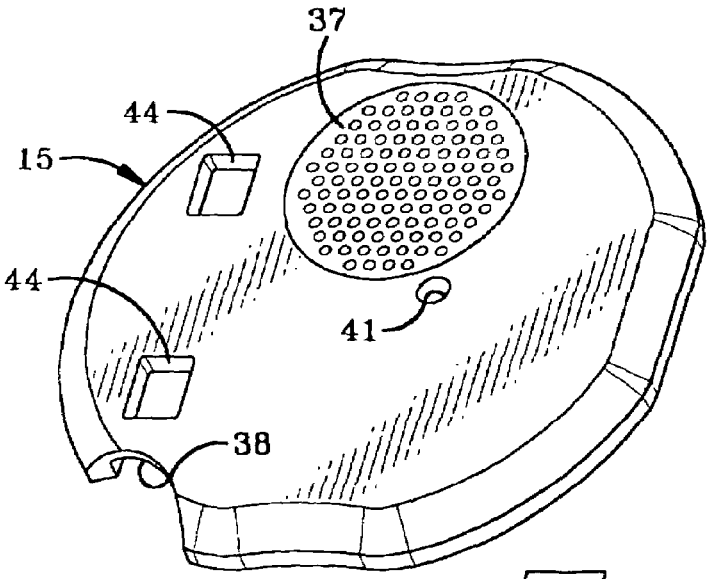
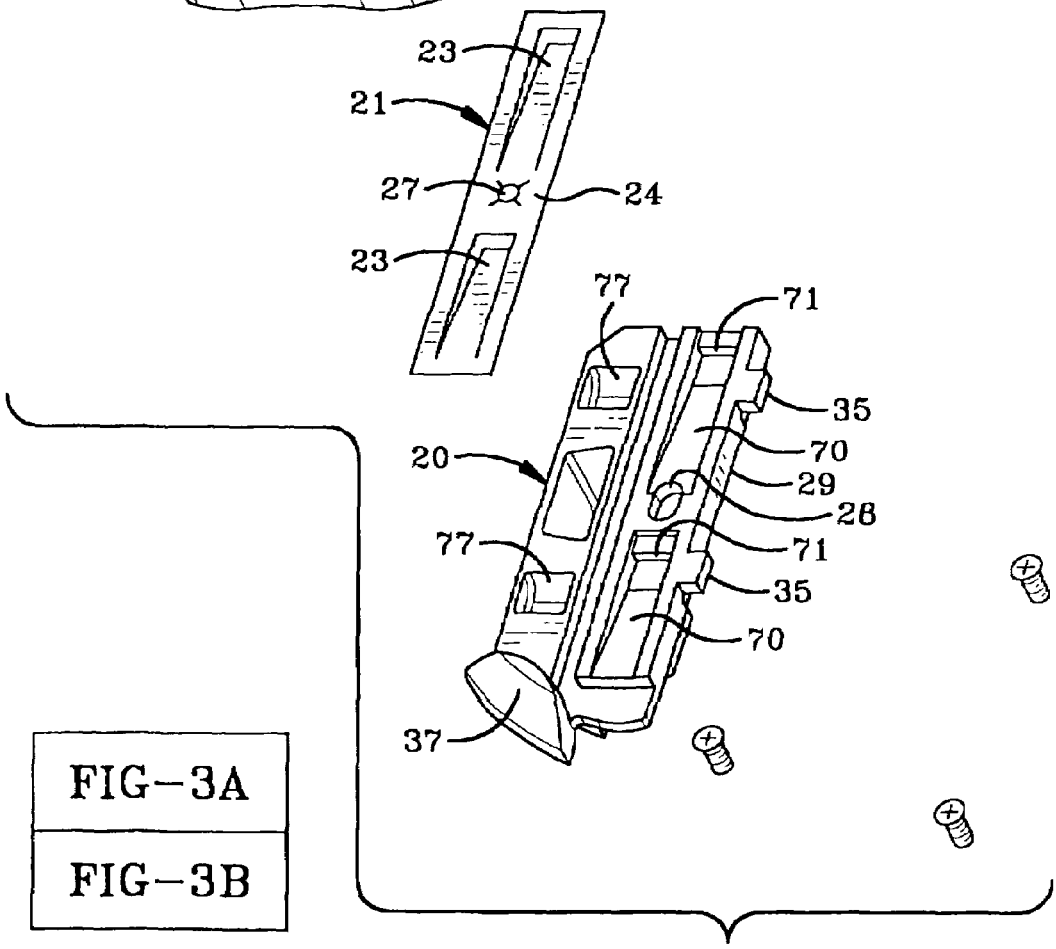
| |
|---|
| FIG–3A |
| FIG–3B |
FIG–3
FIG–3A

BANDING CLIP ALARM

BACKGROUND OF THE INVENTION

1. Technical Field

The invention relates to security devices, and in particular to an alarm for protecting articles which are secured by bands extending about the article. More particularly, the invention relates to an alarm attached to one or more of the bands extending about the article which sounds an alarm if the tension of the band is reduced by unlawful manipulation of the securement bands.

2. Background Information

Retail stores have a difficult time protecting boxes containing various expensive merchandise, books and other similarly structured packages or objects from being opened and the contents thereof being removed without authorization from store personnel. Also, consumers want to visually inspect various packaged expensive articles before deciding to purchase them for reviewing the printed material on the packages and learn other details of the contents. The store is faced with the problem of how to protect these expensive articles from theft while displaying them for sale.

One method used to protect these packages and their contents is to enclose the article within a transparent glass display case which can only be accessed from behind a counter of a retail store. The consumer can view the article through the glass, but is unable to handle the article or read any of the information about the article that may be printed on the box unless a store clerk removes the article from the case. Also, in large retail stores the problem arises of getting the selected merchandise to the customer after the customer wishes to purchase the same without subjecting the merchandise to theft.

Boxes and box-like structures are also subject to unauthorized opening when being shipped via courier. These articles can be easily opened and resealed without the recipient or the sender knowing of such actions. Shipped packages can be secured within a security container with a locking mechanism, but these containers are expensive to purchase and add size and weight to the package making it more expensive to ship. Also, would-be thieves can gain unauthorized access to the contents of these containers by picking the lock mechanism.

Few prior art locking devices have adequately solved the problem of securing packages or objects in a closed condition while being displayed in retail stores or shipped from one location to another. Some prior art security devices include a wire, band or similar ties which wrap around an article and is secured by some type of locking mechanism such as shown in U.S. Pat. No. 3,611,760. Other locking devices have a cable which extend about the object to be secured together with a take-up reel mounted in the lock member for tightening the cable by a crank handle in the lock mechanism such as shown in U.S. Pat. Nos. 3,831,407, 4,756,171, 4,896,517, and 5,156,028. Other security devices use various straps, cables, cords etc. which extend about the object and are secured in some manner such as a permanent seal which requires the surrounding tie to be cut after purchasing of the object by the customer. Although many of these devices perform satisfactory in preventing theft, thieves still are able to circumvent the security provided thereby at times by wiggling, stretching or partially collapsing the container if made of cardboard or other flexible material, sufficiently to slip the band, cable etc. off of the package without disturbing the locking mechanism or cutting the tie which could sound an alarm.

Thus, the need exists for a security device, and in particular an alarm which is adapted for use with an article or package secured by a band, cable, wire or other type of tie which is wrapped about the package, which will sound an alarm should some type of unlawful action reduce the tension on the securement band.

BRIEF SUMMARY OF THE INVENTION

The security device of the present invention is intended for use with wires, cables, bands, cords, ropes or other types of ties which encircle and lock the sides of a box, package, book or similar structure in a secured position. An alarm device is adapted to be engaged with one or more of the security ties and is automatically armed so that upon loosening of the tension in one or more of the ties a switch actuates the alarming device sounding an alarm alerting store personnel that a possible theft is in progress.

In accordance with another aspect of the invention, a visual indicator such as an LED, informs a potential thief and store personnel that the alarming device is armed and protecting the article.

Another aspect of the present invention is the incorporation of a locking device requiring a specialized key which locks the alarm on the band of a protected article preventing unauthorized removal of the alarm from the band.

Another feature of the invention is to enable a specialized magnetic key to unlock the alarm enabling it to be removed easily from the encircling security band without disturbing the securement of the bands around the package, and in which the key when unlocking the device will also inactivate the alarm enabling the alarm to be moved from the article without becoming actuated and emitting an audible alarm.

A further aspect of the invention is the concealment of an EAS tag within the protected interior of the alarm housing which will sound an alarm at a security gate exit should the thief attempt to remove the entire package with the alarm attached thereto from the store.

Another feature of the invention is to provide the alarm with a self-contained power source such as a battery which powers the electronic circuitry which preferably contains a piezo alarm which will emit a high shrieking sound should the alarm be actuated by loosening tension on one or more the plunger switches engaged with the security bands.

A still further feature of the invention is to provide a deactivation switch which is automatically moved by the slide lock when moved to an unlocked position to disarm the alarm enabling it to be removed from the banded package by an authorized clerk.

Another feature of the invention is the use of one or more tactile metal snap dome switches for actuating the alarm upon reduction in band tension.

These objectives and advantages are obtained by the security device of the present invention for use with articles protected by a band extending about the article wherein the device comprises a housing, a lock plate, an alarm located within the housing having a switch for actuating the alarm, at least one passage through at least one of the housing and lock plate for receiving a section of the band therein, and wherein the alarm switch is in communication with the passage and engages the band to prevent the switch from actuating the alarm when the band is under tension

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
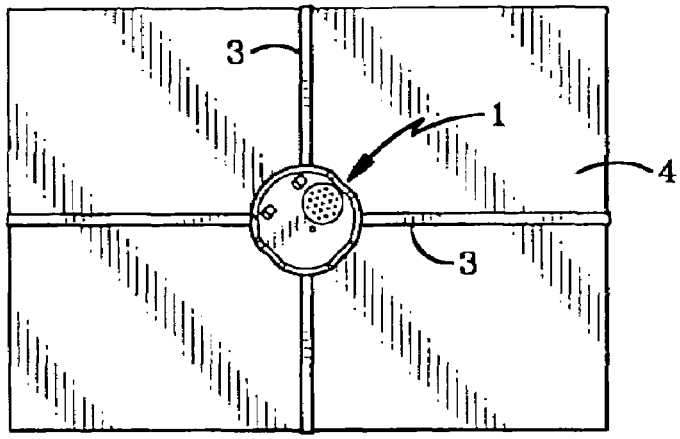
FIG. 1 is a diagrammatic view showing the alarm of the present invention mounted on bands encircling a package.

The alarm of the present invention is indicated generally at 1, and is shown in FIG. 1 locked to a pair of crossing banding straps 3 on a package 4. Package 4 will usually have a parallelepiped configuration, but could have other shapes and configurations without affecting the manner in which alarm 1 is used with the securement bands 3. Likewise, band 3 as referred to throughout, includes wire, rope, cord, cable and various other types of securement ties, all of which can be used with alarm 1 without affecting the concept of the invention.

Figure 3B:
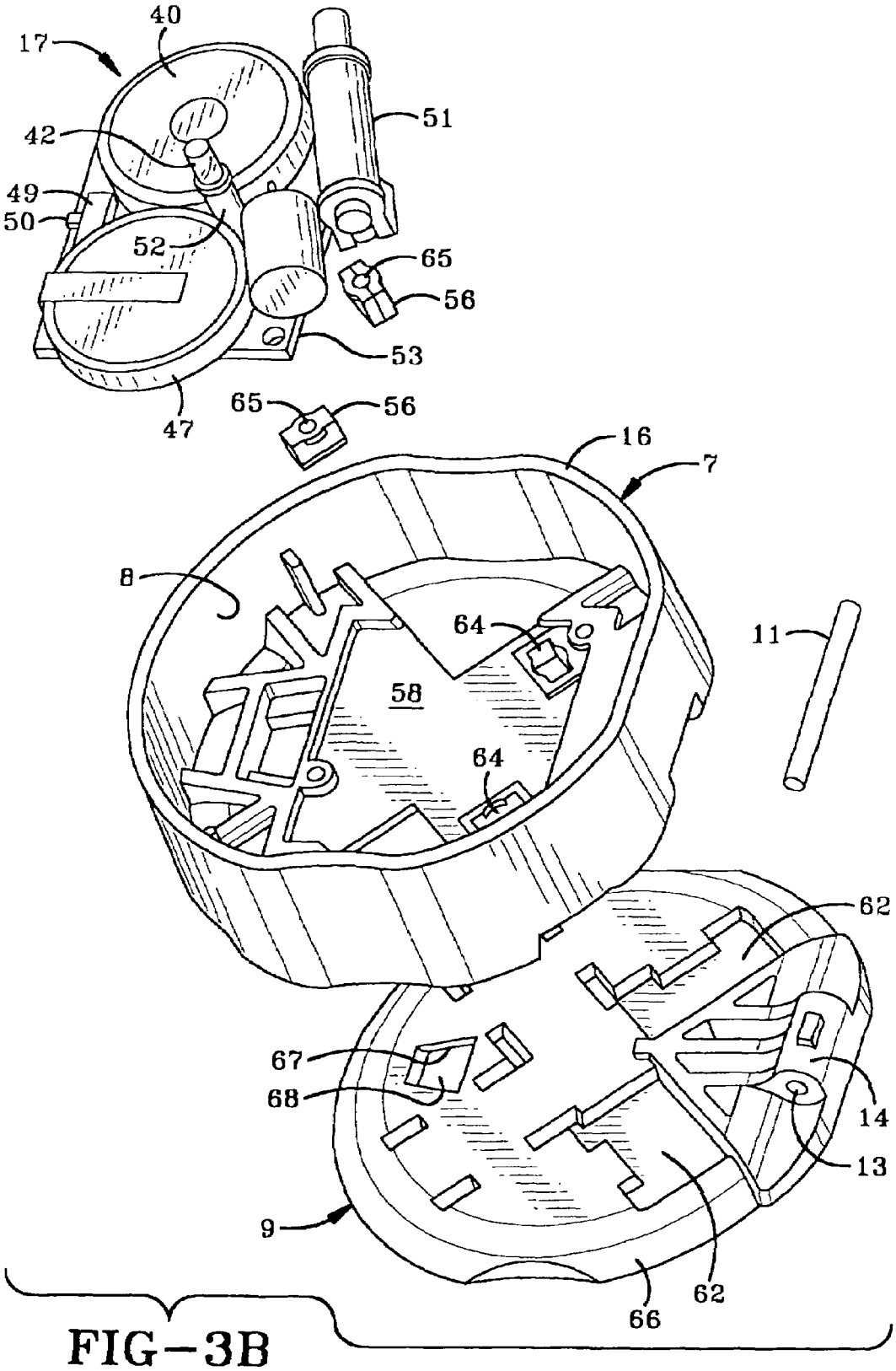
FIG. 3 is an exploded perspective view of the alarm of the present invention shown particularly in FIGS. 3A and 3B.

Alarm 1 is shown in an exploded perspective condition in FIG. 3 (FIGS. 3A and 3B) and includes a main housing indicated generally at 7, having a hollow interior 8, and a bottom lock plate 9 which is hingedly connected to the bottom of housing 7 by a pivot pin 11. Pin 11 extends through a bore 13 formed in a lug 14, with the pin ends being located within a pair of receiving sockets (not shown) formed in housing 7. Alarm 1 further includes a top closure cap indicated generally at 15, which preferably is permanently secured to a top peripheral edge 16 of housing 7 after the various electronic components and alarm circuitry shown generally at 17 in FIG. 3B, are placed in interior 8.

A lock mechanism indicated generally at 19, is located within housing 7 for locking bottom lock plate in a closed locked position to housing 7. Lock mechanism 19 includes a slide lock 20 (FIG. 8) and a metal locking strip 21 (FIG. 3A). Lock strip 21 includes a pair of outwardly extending spring biasing locking tines 23 preferably lanced from the rectangular flat metal strip which forms lock strip 21. Lock strip 21 is mounted in a recess 25 formed in the underside surface of top closure cap 15 preferably by a press fit engagement with a pin 26 extending through a hole 27 formed in the center of lock strip 21 and into an elongated hole 28 formed in an upper surface of slide lock 20.

Figure 2:
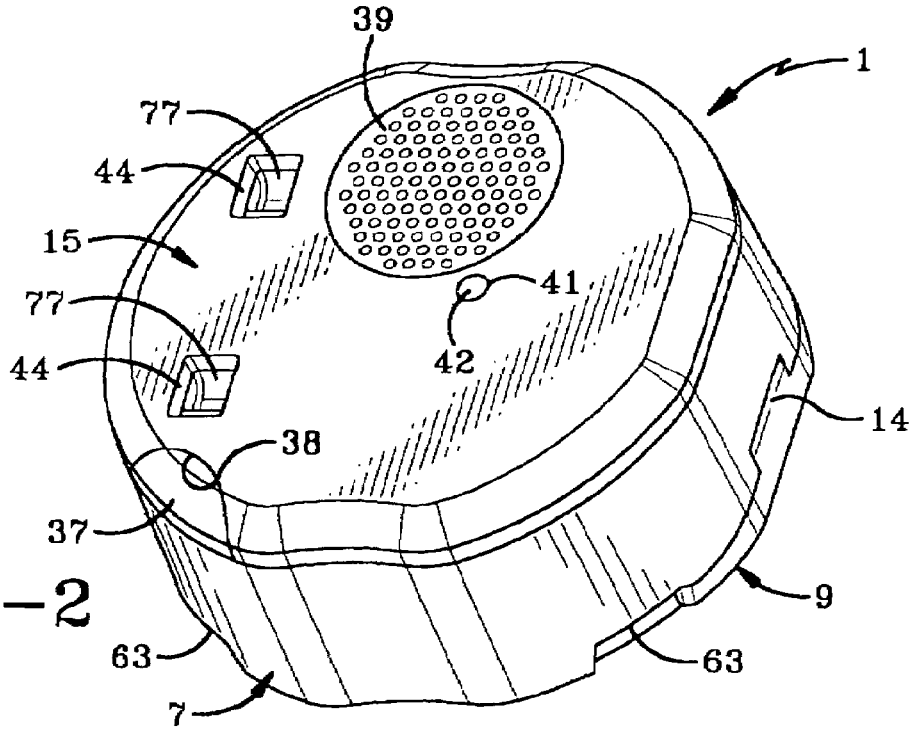
FIG. 2 is a perspective view of the alarm of the present invention.
Figure 4:
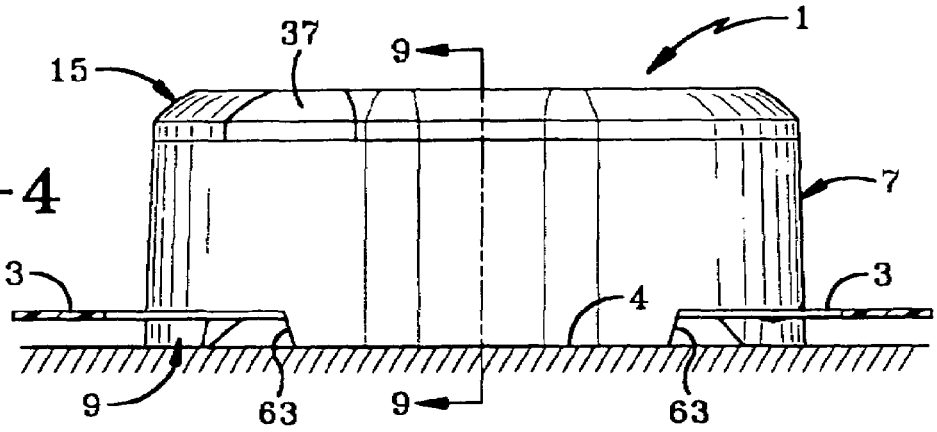
FIG. 4 is a side elevational view of the alarm mounted on a package with the bands shown partially in section.
Figure 8:
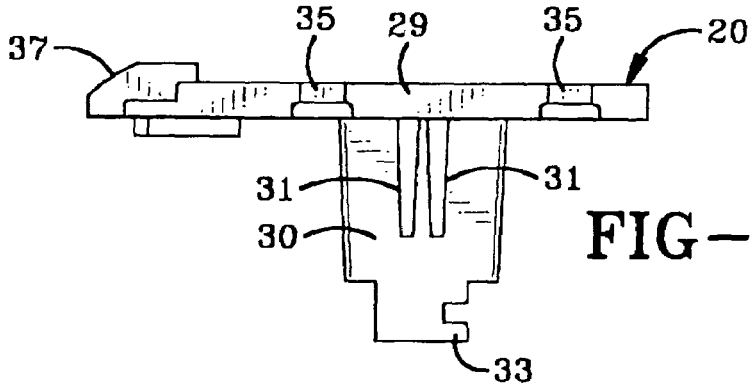
FIG. 8 is a side elevational view of the slide lock component of the alarm.

Slide lock 20 best shown in FIGS. 3A and 8, includes an upper elongated plate 29 and a locking leg 30 extending downwardly orthogonal to plate 29. Leg 30 includes a pair of spaced fingers 31 which extend along locking leg 30 and has a latch 33 at the lower end of leg 30, the functions of which are discussed further below. A pair of spaced outwardly projecting tabs 35 are formed on one side of plate 29 for slidably mounting slide lock 20 within interior 8 of housing 7. Tabs 35 extend into openings 36 formed in a wall 34 on the underside of cap 15. A curved button 37 is mounted at one end of plate 29 and is complementary to and received within a curved recess 38 formed in an outer edge of top closure cap 15 (FIG. 3A) and is seated therein when slide lock 20 is in the locked position as shown in FIG. 2.

Figure 7:
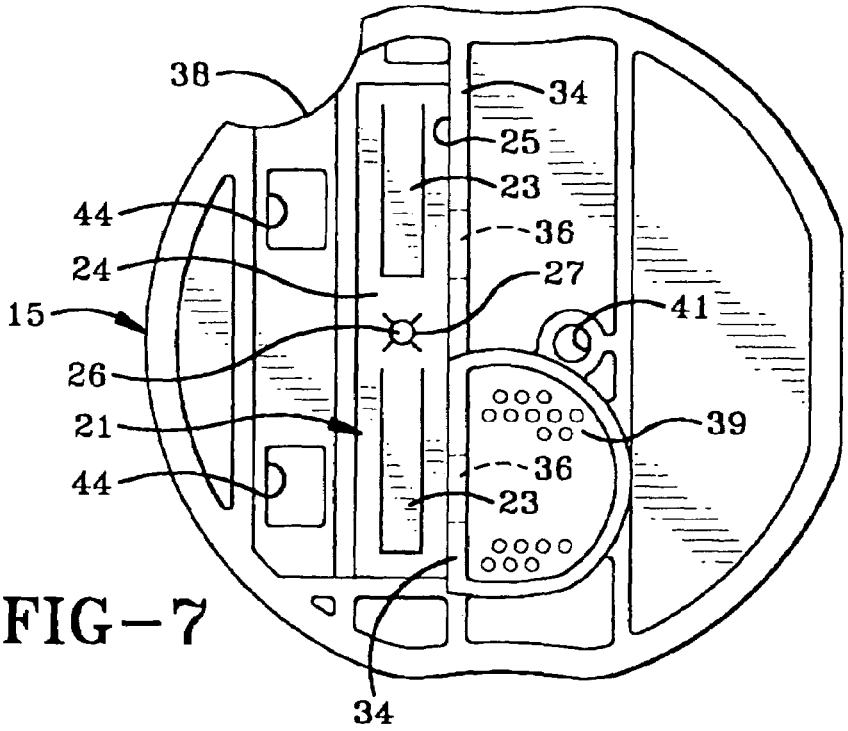
FIG. 7 is a bottom plan view of the alarm housing top closure cap.
Figure 13:
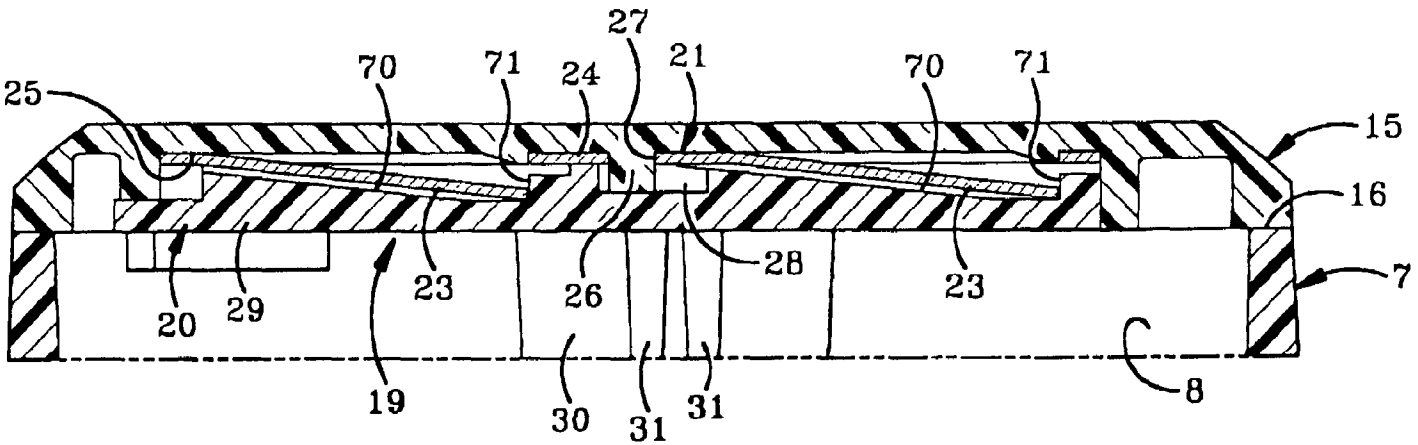
FIG. 13 is an enlarged fragmentary sectional view of the alarm locking mechanism located in the top closure cap in locked position.
Figure 16:
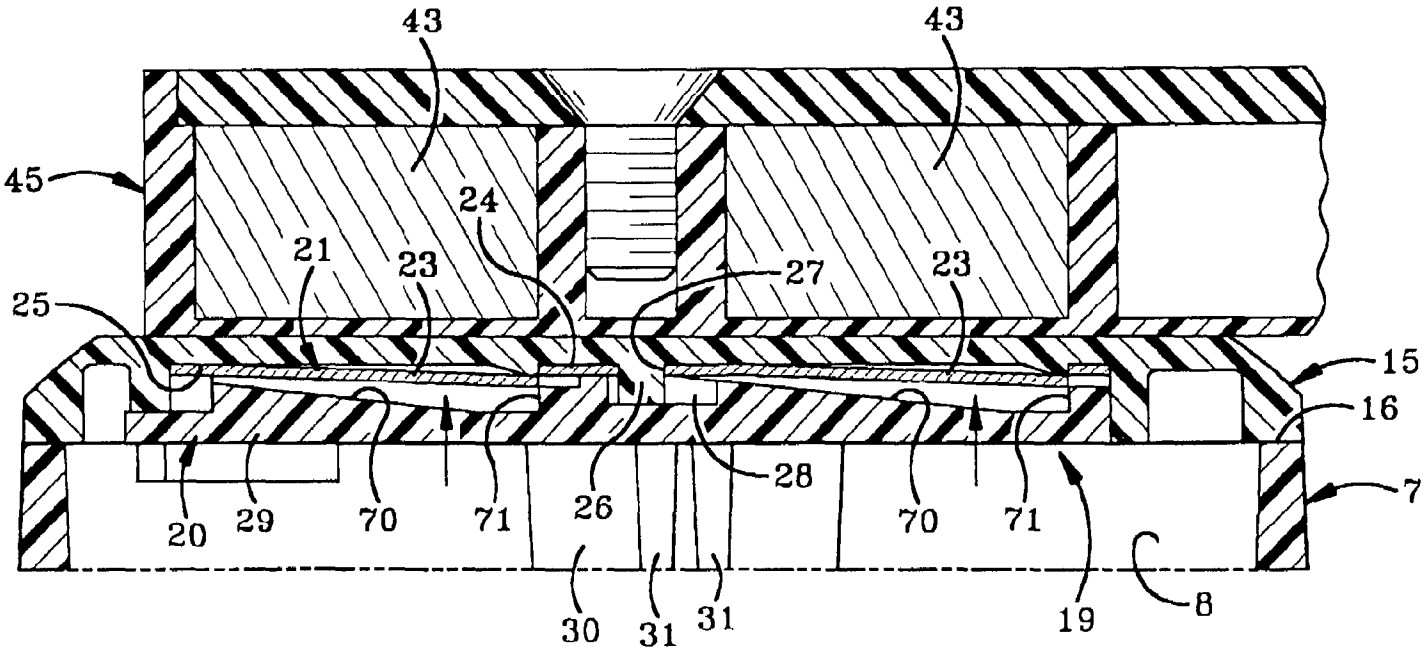
FIG. 16 is an enlarged fragmentary sectional view taken on line 16-16, FIG. 14.
Figure 14:
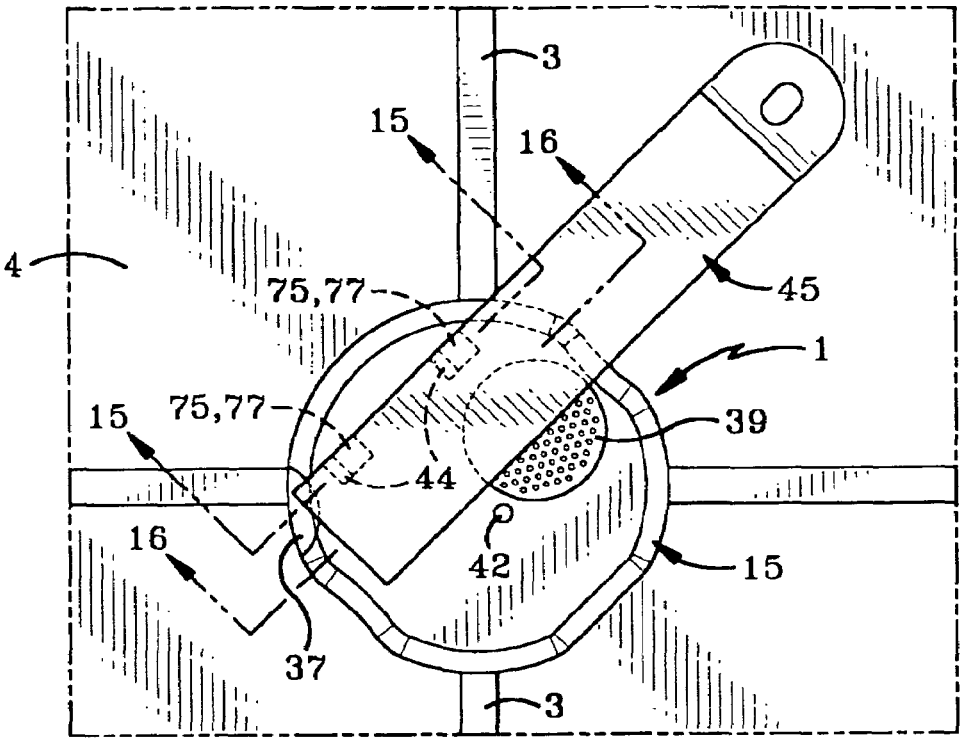
FIG. 14 is a top perspective view showing a magnetic key engaged with the alarm prior to placed the alarm in the unlocked position.
Figure 15:
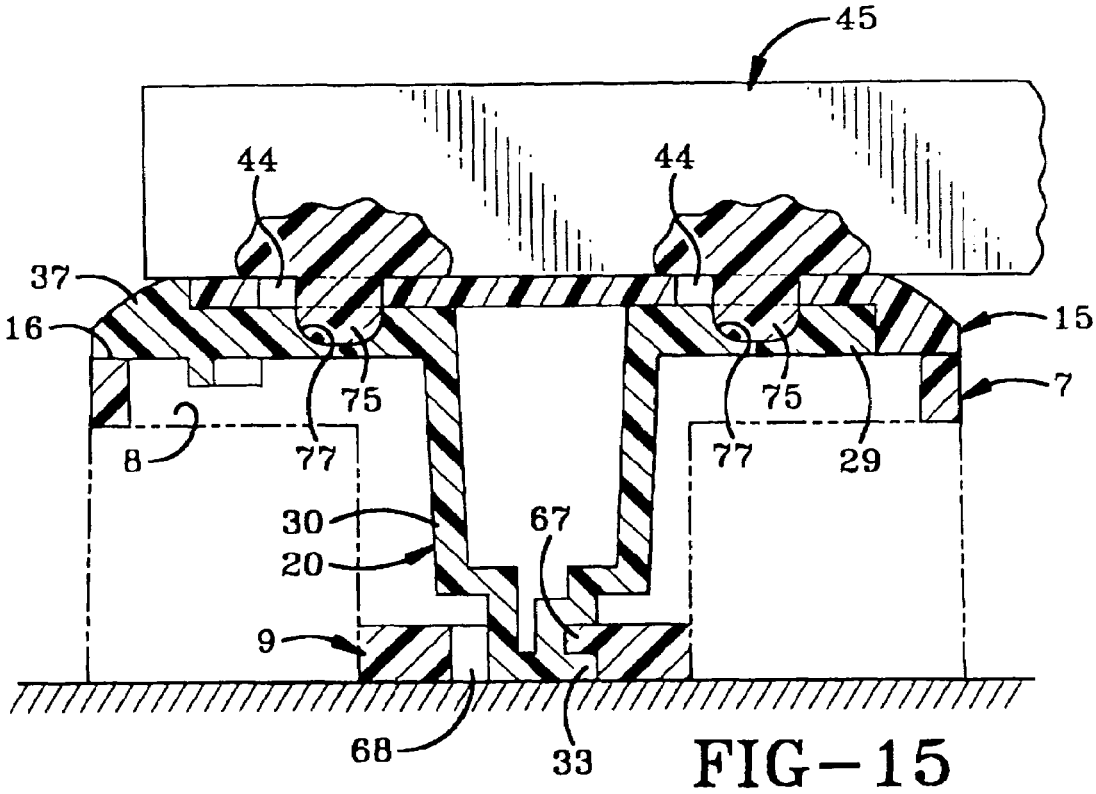
FIG. 15 is an enlarged fragmentary sectional view taken on line 15-15, FIG. 14.
Figure 18:
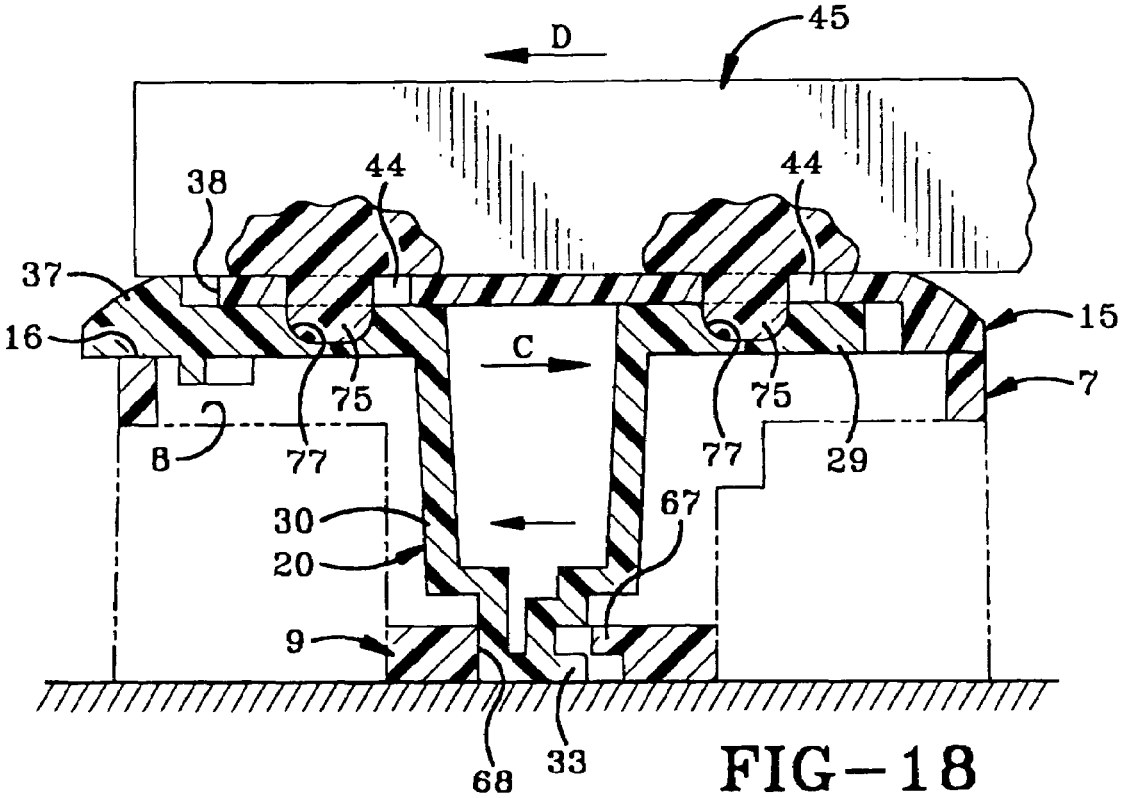
FIG. 18 is an enlarged fragmentary sectional view taken on line 18-18, FIG. 17.

Top closure plate 15 (FIGS. 3A and 7) includes a perforated grill 39 which is located adjacent an audible piezo alarm 40 located within housing 7, which emits a high pitched audible sound when the alarm is actuated as discussed further below. A small hole 41 is formed in top closure cap 15 for receiving an LED 42 which provides a visual indicator that the alarm is armed. Also, a pair of key positioning holes 44 are formed in closure cap 15 for aligning a pair of magnets 43 of magnetic key 45 (FIGS. 14, 15 and 18) with metal tines 23 of lock strip 21 for moving tines 23 from their locked position with slide lock 20 (FIG. 13) to the unlocked position (FIG. 16).

Electronic circuitry 17 (FIG. 3B) preferably includes a battery 47 which is used to power the various electronic components, piezo alarm 40, and a deactivation switch 49 having a control tab 50 extending outwardly therefrom, which is actuated by fingers 31 of slide lock 20 as discussed further below. Circuitry 17 also will include an EAS tag 51 which could be an RF coil, magnetic sensor or various types of electronic article surveillance devices well known in the security art. An LED 42 is mounted on the end of a pedestal 52 enabling LED 42 to be aligned with end cap hole 41, which preferably is illuminated in a solid or flashing mode when the alarm is armed to notify potential thieves that the alarm unit is energized and operating to deter theft. These various electronic components are connected on a printed circuit board 53, which are assembled in a manner well-known in the art.

Figure 10:
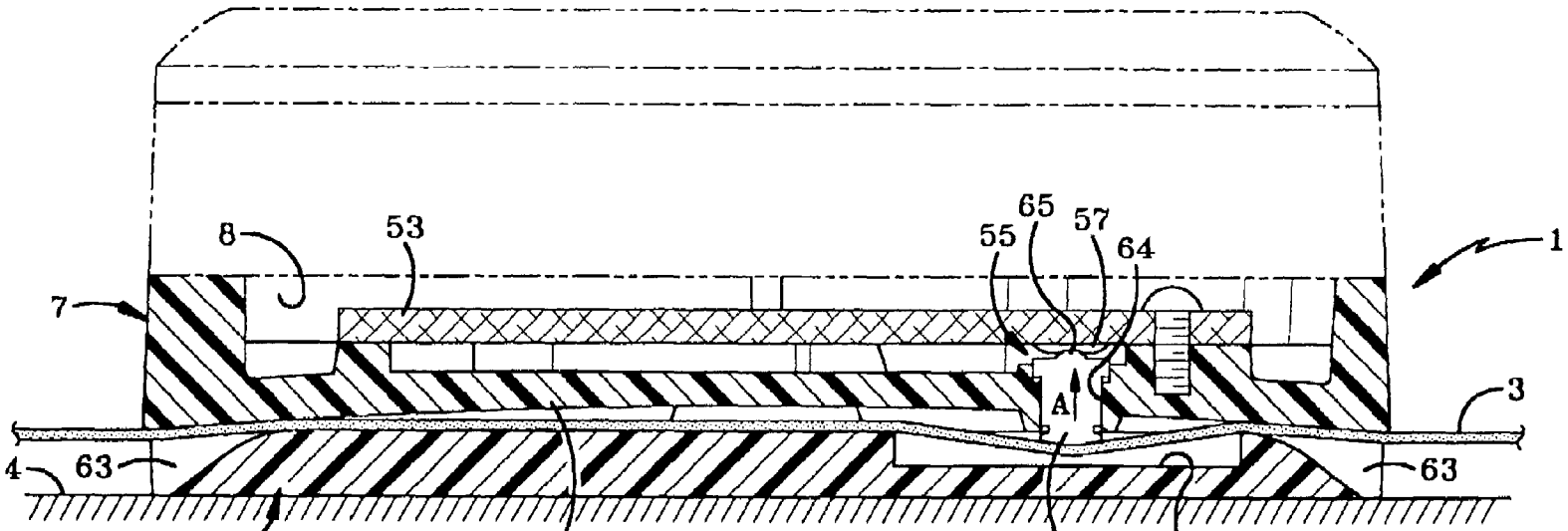
FIG. 10 is an enlarged partial sectional view of the bottom portion of the alarm housing and bottom lock plate in a closed locked position about the band in an armed condition.

In accordance with one of the features of the invention, circuitry 17 will include one or more switch assemblies indicated generally at 55. Each switch assembly 55 will include a plunger 56 which is slidably mounted in a hole 64 formed in bottom wall 58 of housing 7, and a tactile metal dome snap switch 57 which is electrically connected to the circuitry of printed circuit board 53. Plungers 56 project into recesses 62 formed in the inner surface of bottom lock plate 9 (FIG. 10). Switch 57 is formed of a dome-shaped flexible material so that when compressed or expanded will provide either a normally open or normally closed switch. In accordance with one of the aspects of the invention as shown in FIG. 10, when band 3 is in a tension condition around package 4, it will exert a sufficient upward force on plunger 56 as shown by Arrow A, to compress or deflect snap switch 57 to affect the internal switch mechanism which will arm the electronic circuitry of printed circuit board 53.

Figure 5:
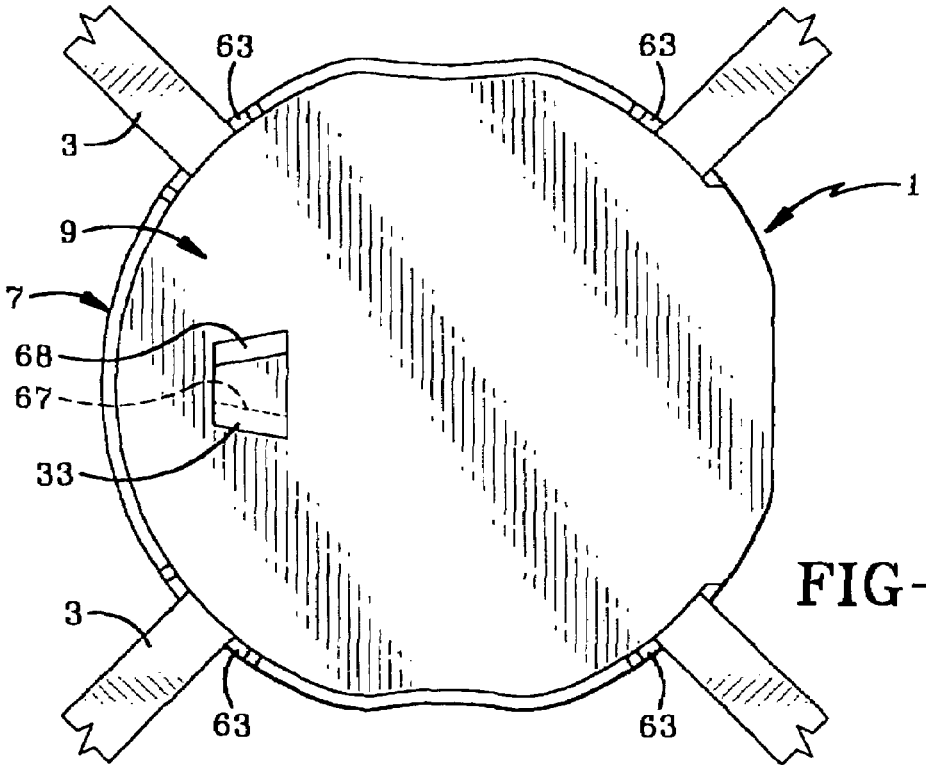
FIG. 5 is a bottom plan view of the alarm with portions of the security bands extending outwardly therefrom.
Figure 6:
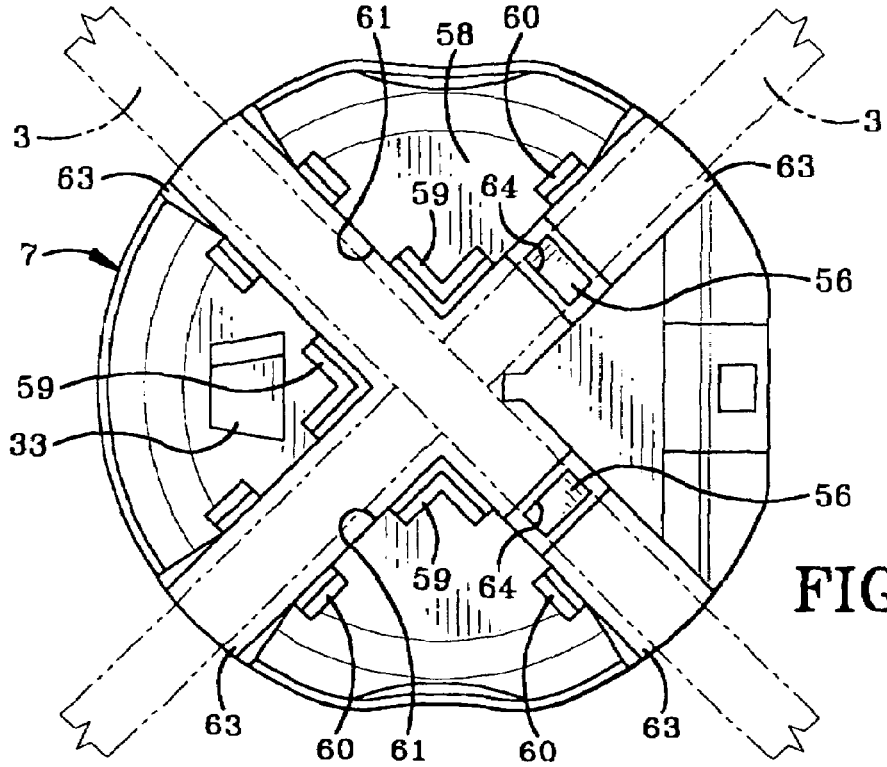
FIG. 6 is a bottom plan view similar to FIG. 5 with the bottom lock plate removed from the housing.

As shown particularly in FIG. 6, a bottom wall 58 of housing 7 is formed with a plurality of projections 59 and 60 which form a plurality of elongated channels or passages 61 therebetween for placement of bands 3 therein. In the preferred use of alarm 1, channels 61 will form a pair of X-shaped passages which are formed in and extend through housing 7 and exit through openings 63 formed in the lower end of housing 7 for passage of bands 3 therethrough. Preferably, channels 61 are formed in an X-shaped pattern as shown in FIG. 6 and are placed on an overlapping or crossing area of the bands as shown in FIG. 1, which when bottom lock plate 9 is in the locked position, will trap the two sections of bands in channels 61 as shown in FIGS. 5 and 6, preventing any sliding movement of the alarm along the band ensuring that the alarm stays in the attached position as shown particularly in FIG. 1.

Figure 12:
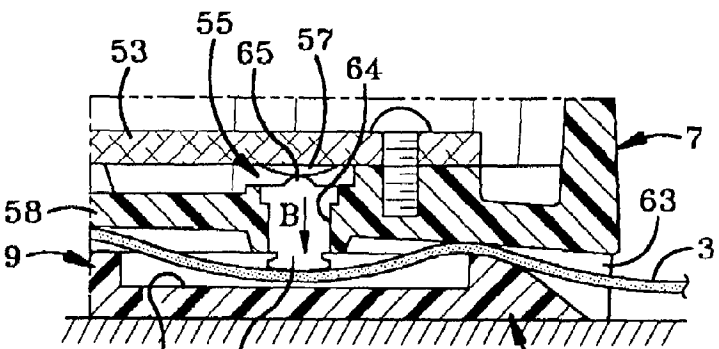
FIG. 12 is a fragmentary sectional view showing the alarm plunger switch being moved to a position for actuating the alarm upon the tension in the band being reduced.
Figure 19:
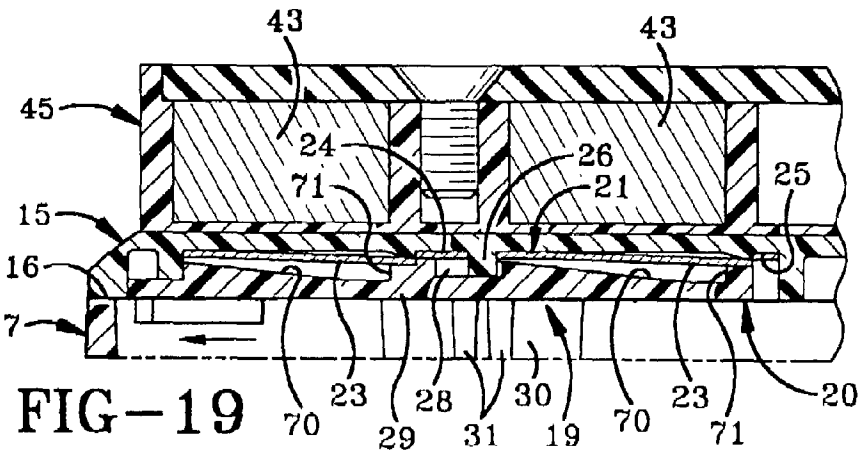
FIG. 19 is an enlarged fragmentary sectional view taken on line 19-19, FIG. 17.

Preferably two plunger actuated snap switches 57 and associated plungers 56 are provided in the alarm, with each of the plungers 56 engaging one of the opposed crossing bands which provides greater security to the protected package than if only one plunger switch was utilized. This ensures that no matter which of the two bands is tampered with, the engaged switch will immediately actuate alarm 40 upon loosening of the tension in the band. This effect is easily seen in FIG. 12. Upon the tension in one of the bands 3 being reduced even a slight amount, the pressure exerted by snap switch 57 will move plunger 56 downwardly as shown by Arrow B, permitting switch 57 to pop outwardly thereby actuating the internal switch. It is understood that switch 57 is chosen so that it has the desired flexibility to enable it to be depressed sufficiently inwardly by a dome-shaped end 65 of plunger 56 as shown in FIG. 10, when the alarm is locked onto an already tensioned band 3, and that switch 57 has sufficient flexibility to move plunger 56 in the direction of Arrow B (FIG. 12) when a certain amount of tension has been reduced on band 3. Thus the pressure exerted by switch 57 moves plunger 56 downwardly as shown in FIG. 12 upon the tension in band 3 diminishing a certain amount actuating the internal switching mechanism of switch 57.

Figure 11:
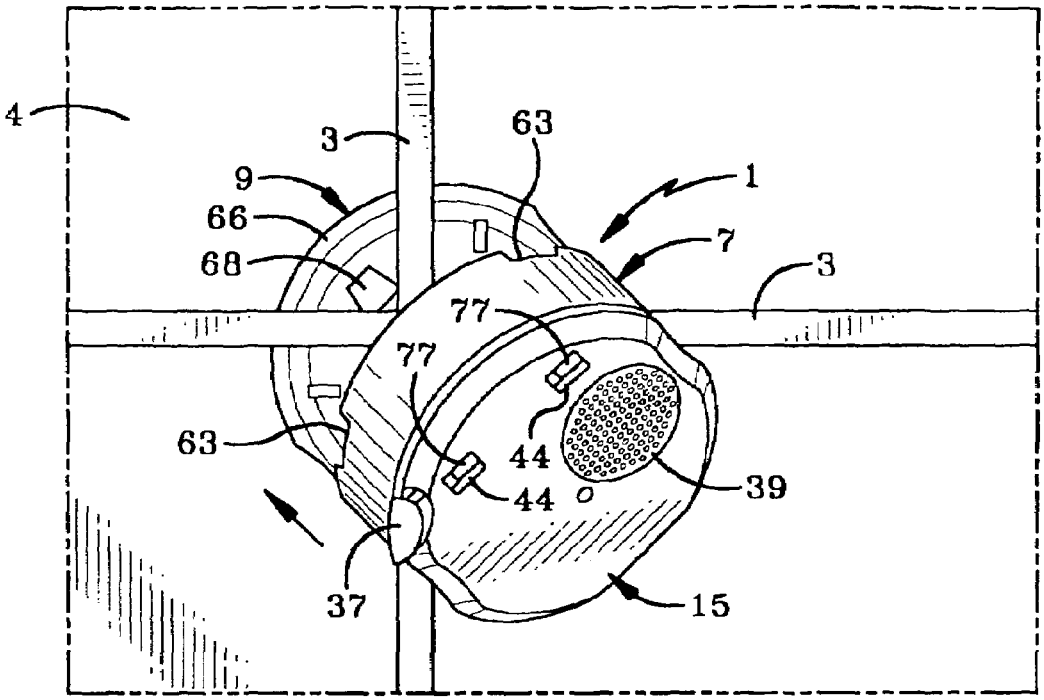
FIG. 11 is a top diagrammatic view showing the bottom lock plate of the housing being slipped beneath a crossed pair of bands for mounting the alarm on the bands as shown in FIG. 10.
Figure 17:
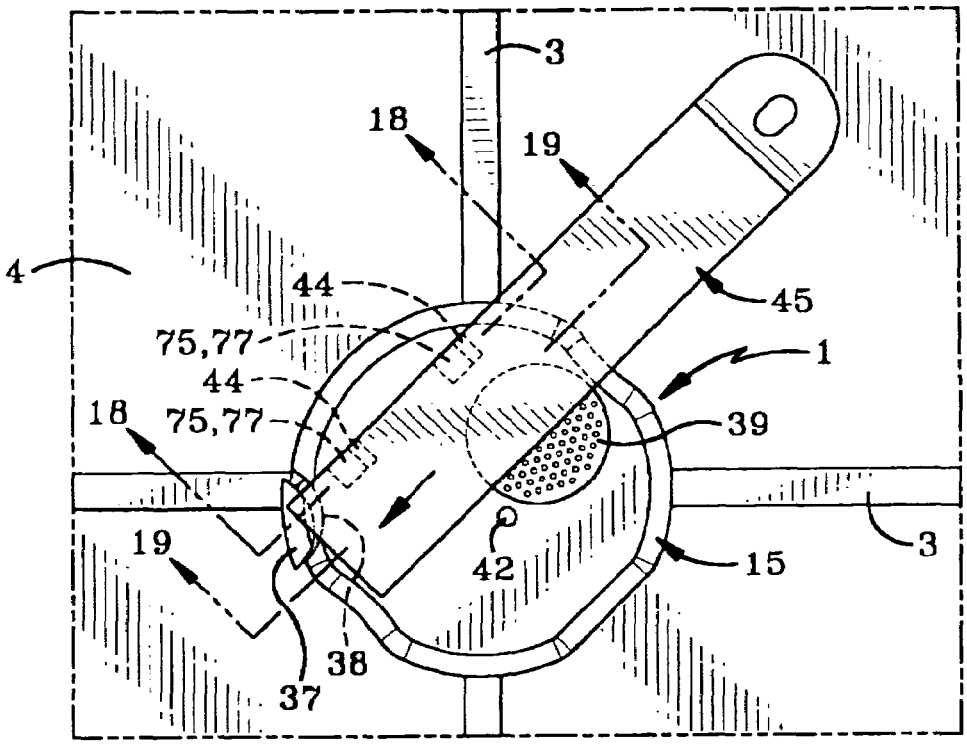
FIG. 17 is a view similar to FIG. 14 showing the magnetic key moving from the locking mechanism from the locked position to the unlocked position.

In accordance with another feature of the invention, bottom lock plate 9 has a tapered outer rim 66 and is of a relatively flat planar thin configuration enabling it to be slip-fitted beneath the tensioned bands as shown in FIG. 11, with bands 3 being located within channels 61, after which housing 7 is pivoted about pin 11 to a closed positioned trapping the bands between bottom plate 9 and bottom wall 58 of housing 7. Lock button 37 is then merely moved manually inwardly from the open position of FIGS. 17 and 18 to the locked position of FIGS. 14 and 15. The inward movement of lock button 37 will slide or move slide lock 20 in the direction of Arrow C (FIG. 18) whereupon latch 33 at the bottom of leg 30 will slide beneath a ledge 67 formed adjacent a bottom opening 68 formed in lock plate 9. Upon reaching the locked position of FIG. 15, spring biased tines 23 move into a pair of aligned recesses 70 formed in slide lock 20 (FIGS. 3A and 13) where the distal ends thereof abut against shoulders 71 formed at the ends of recesses 70, preventing sliding movement of the slide lock and latch 33 from the locked position to the unlocked position. Again, upon the pivotal movement of housing 7 from the position of FIG. 11 to the closed position of FIGS. 9 and 10, plungers 56 will automatically engage tensioned bands 3 and move upwardly in the direction of Arrow A (FIG. 10) depressing snap switches 57 and arming the alarm through the connected electronic circuitry 17. Upon arming of the alarm circuitry, LED 42 will be illuminated indicating to the clerk and potential thief that the alarm is armed.

Figure 9:
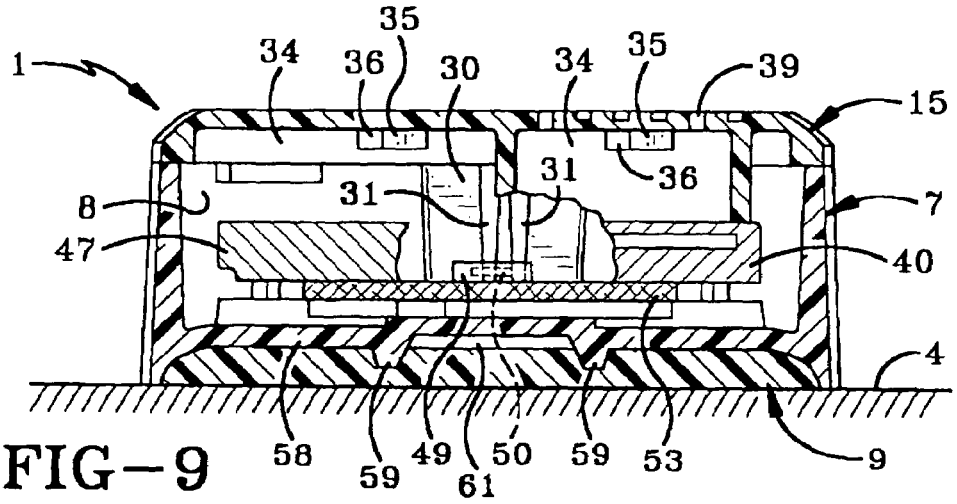
FIG. 9 is a sectional view taken on line 9-9, FIG. 4.
Figure 20:
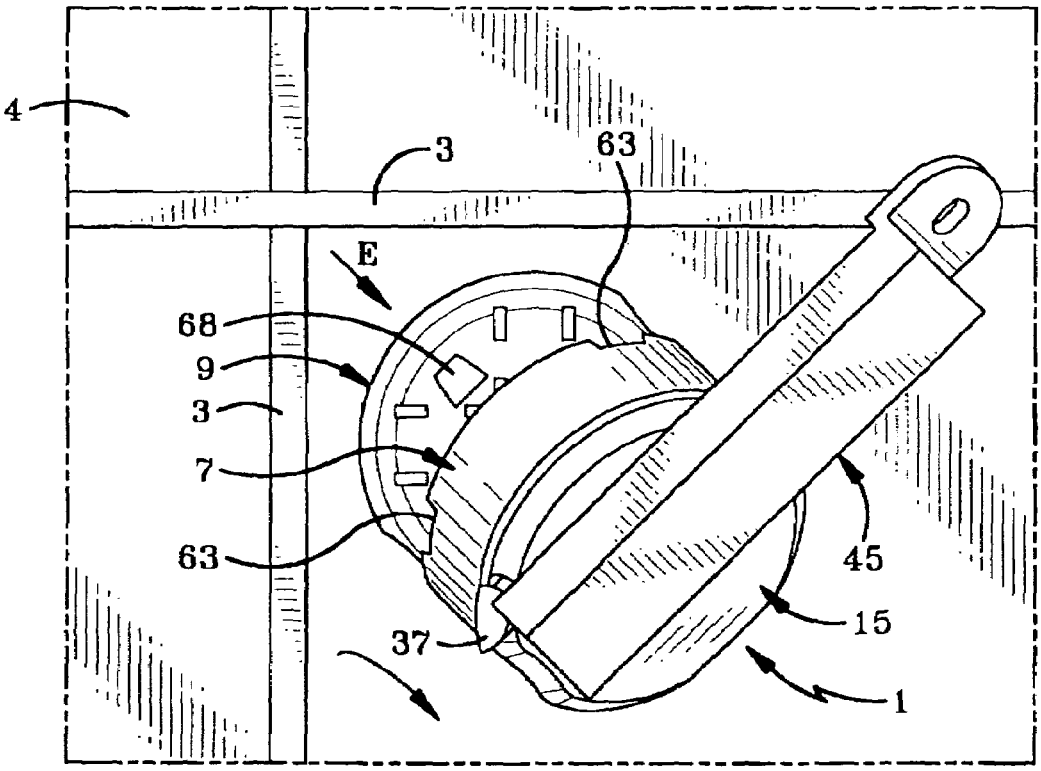
FIG. 20 is a top plan view showing the alarm in the unlocked position being removed from beneath the crossed securement bands.

Alarm 1 is easily deactivated and removed from band 3 upon the sale of the protected item or when the alarm is no longer needed by the use of magnetic key 45. Key 45 has a pair of tabs 75 which are inserted through holes 44 formed in top closure cap 15 (FIGS. 14, 15 and 18) and into holes 77 formed in the upper surface of slide lock 20 for moving the slide lock from the locked to the unlocked position. Key 45 is moved easily in the direction of Arrow D (FIGS. 17 and 18) moving slide lock 20 for disengaging latch 33 from locking ledge 67 since magnets 43 when aligned with tines 23, move the tines from their locked position of FIG. 13 to the unlocked position of FIG. 16 enabling slide lock 20 to be moved to the unlocked position. Upon reaching the unlocked position, housing 7 is easily pivoted away from lock plate 9 as shown in FIG. 20, enabling the lock plate to be slid easily from beneath the crossed bands 3 as shown by Arrow E in FIG. 20. Also, upon the sliding movement of slide lock 20 from the locked to the unlocked position, the corresponding movement of locking leg 30 as shown in FIG. 9, will move activation switch 49 to deactivate the alarm preventing piezo alarm 40 from sounding.

Thus, all that is required to safely remove the alarm from its engagement with bands 3 and the automatic deactivation of the alarm is the insertion of magnetic key positioning tabs or projections 45 through holes 44 and into slide lock holes 77 followed by a very slight sliding movement of the key to move slide lock 20 a sufficient distance to disengage latch 33 from ledge 67. This will permit the pivotal movement of housing 7 away from bottom lock plate 9. Likewise, the movement of slide lock 20 and locking leg 30 will move control tab 50 of deactivation switch 49 preventing the sounding of the alarm. Again, the alarm can be reused on another package by slipping the relatively thin, flat lock plate 9 beneath the already applied and tensioned bands 3 as shown in FIG. 11, followed by the pivotal closing of housing 7 onto lock plate 9 which automatically traps the bands in channels 61. Then the slight manual depression of lock button 37 into recess 38 will move slide lock 20 to engage latch 33 with ledge 67 and automatically engage biased locking tines 23 into recesses 70 of slide lock 20. Activation switch 49 is reactivated by movement of locking leg fingers 31 and control tab 50 to reactivate and arm the alarm upon the automatic movement of button switches 57 by engagement with tensioned bands 3.

Thus, alarm 1 provides a relatively simple and easily used security device which can be applied to various types of security ties such as bands, ropes, wires, cables, cords etc. The alarm when locked on the band automatically moves or actuate one or more switches by their engagement with the tensioned bands, which switches will automatically cause an audible alarm to be sounded upon reduction in tension on one or more of the bands. Thus, should a band be cut or the box collapsed around the band in attempting to remove the same or other type of unlawful manipulation, will immediately actuate the audible alarm notifying the store personnel of a theft in progress. Likewise, the alarm preferably contains an EAS tag which will actuate the security system at an exit gate in a manner well-known in the art should a thief attempt to remove the protected container with the alarm attached. Alarm 1 is easily unlocked by a magnetic key or other type of locking key mechanism, such as a key operated tumbler etc., enabling the housing to be pivoted away from the locking base plate which is then easily slid out from between the tensioned bands and article being protected thereby.

It is also readily understood that alarm 1 could be attached to a single tensioned member whether it be wrapped around an article or is tensioned in a different manner for protecting another item other than a parallelepiped-shaped article as shown in the drawings. Also, battery 47 provides a self-contained power source for operating the alarm and its concealment within the interior of locked housing 7, together with the various electronic circuitry, is not accessible to a would-be thief. It is also understood that electronic circuitry 17 could have various arrangements, components etc. well known in the security alarm art including the printed circuit board and the tactile metal dome switches 57 without affecting the concept of the invention. Other types of spring biased switches can be utilized if desired, but the tactile metal dome snap switches have been found to perform satisfactory for their intended purpose.

Furthermore, the band is freely slidable through the alarm housing passages and only engages the ends of plungers 56 to prevent them from moving into recesses 62 and actuating snap switches 57 so long as tension remains on the bands. Recesses 62 enable the bands to curve slightly into the recesses from the pressure exerted thereon by snap switch 57 and then move further into the recesses when tension on the bands is reduced as shown in FIGS. 10 and 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device for an article protected by a band extending about the article, said device comprising:

a housing;

a lock plate moveable between locked and unlocked positions with said housing;

an alarm located within the housing having a switch for actuating the alarm;

at least one passage extending linearly completely through at least one of the housing and lock plate for receiving and trapping a section of the band therein and for removably locking the security device to the band when the lock plate is in the locked position with the housing; and said alarm switch being in communication with the passage and adapted to engage the band to prevent the switch from actuating the alarm when the band is under tension.

2. The security device defined in claim 1 wherein the alarm actuation switch is a plunger switch which is moved to an armed position against the band when the band is in a tensioned condition about the article.

3. The security device defined in claim 1 wherein the at least one passage includes two passages formed in the housing in an X-configuration for receiving crossing sections of the band therein; and in which two alarm actuation switches are located in the housing and project into the two passages for actuating the alarm when tension on at least one of the bands is reduced.

4. The security device defined in claim 1 wherein the lock plate is pivotally mounted on the housing; and in which a lock mechanism locks the lock plate in a locked position to the housing to trap the band in the at least one passage.

5. The security device defined in claim 4 wherein the lock is a magnetically operated lock.

6. The security device defined in claim 4 wherein the base is a thin generally flat planar plate adapted to slide between the band and article for trapping the band in the at least one passage upon locking the base to the housing.

7. The security device defined in claim 4 wherein the housing is formed with at least one channel forming the passage for receiving the band therein.

8. The security device defined in claim 4 wherein the lock includes a latch which slidably engages a ledge formed in the lock plate to lock the lock plate to the housing.

9. The security device defined in claim 1 wherein the alarm includes a visual indicator light that the alarm is in an operative state.

10. The security device defined in claim 1 wherein the alarm includes an audible alarm.

11. The security device defined in claim 1 wherein the alarm switch includes a metal dome snap switch and a plunger operatively connected thereto.

12. The security device defined in claim 1 wherein a lock mechanism locks the lock plate to the housing; and in which the alarm includes a disarming switch which is operatively engaged by the lock mechanism when the lock mechanism moves from a locked position to an unlocked position to disarm the alarm.

13. The security device defined in claim 12 wherein the lock mechanism includes a magnetically operable lock member and a slide lock engageable therewith; and in which the slide lock has a latch engageable with the lock plate to secure the lock plate in locked position to the housing.

14. A method of protecting an article secured by a band extending about the article under tension, comprising the steps of:

providing a housing having an alarm and a lock plate connected to the housing;

sliding the lock plate under the tensioned band;

locking the lock plate to the housing trapping the tensioned band therebetween with the tensioned band extending in a continuous linear manner through said housing;

arming the alarm by depressing a switch located in the housing upon locking the lock plate to the housing and the tensioned band engaging the switch; and actuating the alarm by moving the switch upon tension in the band being reduced.

15. The method defined in claim 14 including the steps of providing a visual indication that the alarm has been armed; and providing an audible signal when the alarm has been activated.

16. The method defined in claim 15 including the step of locating an EAS tag in the housing.

17. The method defined in claim 14 including the step of providing a pair of passages in an X-configuration in the housing; and receiving a crossing junction of the band in said passages to prevent sliding movement of the housing along the band.

18. The method defined in claim 14 including the steps of unlocking the base from the housing by placing a magnet adjacent a lock mechanism in the housing; and sliding a locking latch to an unlocked position.

19. In combination an article protected by a band extending about the article and having crossing sections and a security device connected to the band at the crossing sections, said security device comprising:

a housing;

a lock plate;

an alarm located within the housing having a switch for actuating the alarm;

two passages extending through at least one of the housing and lock plate having an X-configuration receiving the crossing sections of the band therein; and said alarm switch being in communication with at least one of the passages and engaging one of the crossing sections of the band, said switch being armed by the band when under tension and actuated to sound an alarm when the tension in said one of the crossing section of the band is reduced.

20. A security device for an article protected by a band extending about the article, said device comprising:

a housing;

a lock plate;

two passages formed in the housing in an X-configuration for receiving crossing sections of the band therein; and two alarm actuation switches located in the housing and projecting into the two passages for engaging the band to prevent the switch from actuating the alarm when the band is under tension and for actuating the alarm when tension on at least one of the crossing sections of the band is reduced.

21. A security device for an article protected by a band extending about the article, said device comprising:

a housing;

a lock plate;

an alarm located within the housing having a switch for actuating the alarm, and alarm switch including a metal dome snap switch and a plunger operatively connected thereto:

at least one passage extending through at least one of the housing and lock plate for receiving a section of the band therein;

said alarm switch being in communication with the passage and adapted to engage the band to prevent the switch from actuating the alarm when the band is under tension.

22. A method of protecting an article secured by a band extending about the article under tension, comprising the steps of:

providing a housing having an alarm and a lock plate connected to the housing;

providing a pair of passages in an X-configuration in the housing;

sliding the lock plate under the band;

receiving a crossing junction of the band in said passages to prevent sliding movement of the housing along the band;

locking the lock plate to the housing trapping the band therebetween;

arming the alarm by a switch engaging the tensioned band upon locking the lock plate to the housing; and actuating the alarm upon tension in the band being released.

* * * * *